US005687881A

United States Patent [19]

Rouse et al.

[11] Patent Number: 5,687,881

[45] Date of Patent: Nov. 18, 1997

[54] APPARATUS FOR CONVEYING A SOLID PARTICULAR MATERIAL

[75] Inventors: Michael W. Rouse, Vicksburg, Miss.; Lowell C. Sundermann, Muscatine, Iowa

[73] Assignee: Bandag, Incorporated, Muscatine, Iowa

[21] Appl. No.: 544,697

[22] Filed: Oct. 18, 1995

[51] Int. Cl.[6] ..... B67D 3/00

[52] U.S. Cl. ..... 222/185.1; 222/105; 222/181.2; 222/143; 222/517; 222/556; 414/422; 414/608

[58] Field of Search ..... 222/556, 185.1, 222/181.1, 181.2, 105, 143, 517, 511, 527, 528; 414/422, 414, 607, 608; 383/906; 220/1.5

[56] References Cited

U.S. PATENT DOCUMENTS

| | | | |
|---|---|---|---|
| 3,105,617 | 10/1963 | Felldin | 222/181.2 |
| 3,464,594 | 9/1969 | Forman | 222/181.2 X |
| 3,719,296 | 3/1973 | Larson, Jr. | 414/422 |
| 3,961,655 | 6/1976 | Nattress et al. | 222/181.2 X |
| 4,423,831 | 1/1984 | Sipley | 222/185.1 X |
| 5,238,194 | 8/1993 | Rouse et al. . | |
| 5,340,218 | 8/1994 | Cuthbertson | 222/181.2 X |
| 5,441,321 | 8/1995 | Karpisek | 222/556 X |

OTHER PUBLICATIONS

Why The Bulk Lift Bag Is "The Number 1 Bulk Bag in America . . . " Bulk Lift International, Incorporated, Carpentersville, Illinois (9 pages).

A Guide To Selecting Bulk Bags And The Equipment To Utilize Them, Taylor Products Co., Parsons, Kansas (20 pages).

*Primary Examiner*—Kevin P. Shaver
*Attorney, Agent, or Firm*—Foley & Lardner

[57] ABSTRACT

An improved apparatus for conveying solid particulate material which includes a generally flexible receptacle fixedly situated within a frame. The receptacle has a top, a bottom, at least one wall defining an interior and a longitudinal axis perpendicular with the top and bottom. The improvement comprises a dump structure at the bottom comprising a dump aperture, a first flap, and a second flap. The first flap has a first connection along a first flap width with the wall and with the frame adjacent to the dump aperture, extends a first length from the first connection, and is swingable about the first connection from a first position blocking the dump aperture toward an open position. The second flap has a second connection along a second width with the wall and with the frame adjacent to the dump aperture and is swingable about the second connection from a closed position blocking the dump aperture toward an open position. The dump structure further comprises at least one side flap being connected with the wall adjacent to the dump aperture intermediate the first flap and the second flap. Each side flap has a third connection along a third width with the wall and a fourth connection with the first flap along the first length. A first bias member urges the second flap toward the closed position. Second bias members urge each side flap toward the interior.

20 Claims, 7 Drawing Sheets

APPARATUS FOR CONVEYING A SOLID PARTICULAR MATERIAL

BACKGROUND OF THE INVENTION

The present invention is an apparatus for conveying a solid particulate material. In particular, the invention facilitates conveying, loading, storing, and unloading of solid particulate material. The apparatus of the present invention is especially useful with solid particulate material which tends to bridge container openings in dumping operations and thereby preclude efficient dumping of the material from the container.

Some particulate materials are particularly dirty and particularly configured to bind or bridge a container opening during dumping and block remaining material from being dumped from the container. One example of such a material is ground automotive tires. Automotive tires may be ground to a powder involving particles of approximately 40–50 microns in diameter (generally of the size of talcum powder particles). Such ground tire material is loaded into large sack-like containers, stored, and sold to tire companies or asphalt companies for use in their products.

It is useful to provide containers which can efficiently store such particulate material (or other particulate material). It is important that such containers can be dumped in a manner insuring substantially emptying a container without requiring that operating personnel be located closely in proximity with the containers to execute dumping operations. If one is too close to such a container when it is dumped, he may be showered with the material being dumped. Such a showering is particularly unpleasant when the material is ground tire material in a dust form. Such discomfort may likely contribute to hasty execution of dumping and less than desired attention to detail by operating personnel in order to avoid an unpleasant "dusting". Such hasty, inattentive execution of dumping may result in unsafe procedures with unfortunate injurious consequences. It would be of particular advantage for a container to be configured so that it may be handled, stored, dumped, and re-closed using mechanical means not requiring close proximity to the container.

Of particular advantage, would be a tote or bag storage system suspended in a frame with a drop bottom which forms a funnel when the frame is unlocked.

It would be of further advantage if automatically biased towards closing when the material is substantially fully dumped from within the container.

SUMMARY OF THE INVENTION

An improved apparatus for conveying solid particulate material which includes a generally flexible receptacle substantially fixedly situated within a space delimited by a frame.

The term "solid particulate material" is intended to in include an solid material which is embodied in pieces, chunks, or particles of sizes which permit containment of a plurality of the pieces, chunks or particles within the apparatus. The apparatus is particularly well-suited for handling particles ranging in size from 2000 microns to less than 1 micron.

The receptacle has a top, a bottom, and at least one wall connecting the top with the bottom and defining an interior. The receptacle is coupled with the frame at a plurality of coupling loci. The frame has a longitudinal axis substantially perpendicular with the top and with the bottom of the receptacle when the receptacle is substantially fixedly located within the frame. The receptacle has a fill structure at the top for providing filling access to the interior. The improvement comprises a dump structure at the bottom for providing dumping access to the interior. The dump structure comprises a dump aperture, a first flap, and a second flap. The first flap has a first articulate connection along a first flap width with the at least one wall and with the frame adjacent to the dump aperture. The first flap extends a first flap length from the first articulate connection and is swingingly positionable about the first articulate connection from a first position substantially blocking the dump aperture toward an open position. A first plane, substantially containing the first flap forms an acute angle with the axis when the first flap is in the open position. The second flap has a second articulate connection along a second flap width with the at least one wall and with the frame adjacent to the dump aperture. The second flap extends a second flap length from the second articulate connection and is swingingly positionable about the second articulate connection from a closed position substantially blocking the dump aperture toward an open position. A second plane substantially containing the second flap forms an acute angle with the axis when the second flap is in the open position. The dump structure further comprises at least one side flap being articulately connected with the at least one wall substantially adjacent to the dump aperture intermediate the first flap and the second flap. Each respective side flap has a third articulate connection along a third flap width with the at least one wall and a fourth articulate connection with the first flap substantially along the first flap length. A first bias member coupled with the second flap urges the second flap toward the closed position. A second bias member coupled with each respective side flap urges the respective side flap toward the interior.

It is, therefore, an object of the present invention to provide an improved apparatus for conveying a solid particulate material which is configured to facilitate dumping of the particulate material from the apparatus.

It is a further object to present invention to provide an improved apparatus for conveying a solid particulate material which may be remotely manipulated for effecting dumping operations and for closing the apparatus upon completion of dumping operations.

It is yet a further object of the present invention to provide an improved apparatus for conveying a solid particulate material which incorporates a dump structure which automatically is biased toward a closed position upon substantial completion of dumping of material from the apparatus.

Further objects and features of the present invention will be apparent from the following specification and claims when considered in connection with the accompanying drawings illustrating the preferred embodiment of the invention.

DETAILED DESCRIPTION OF THE INVENTION

Figure 1:
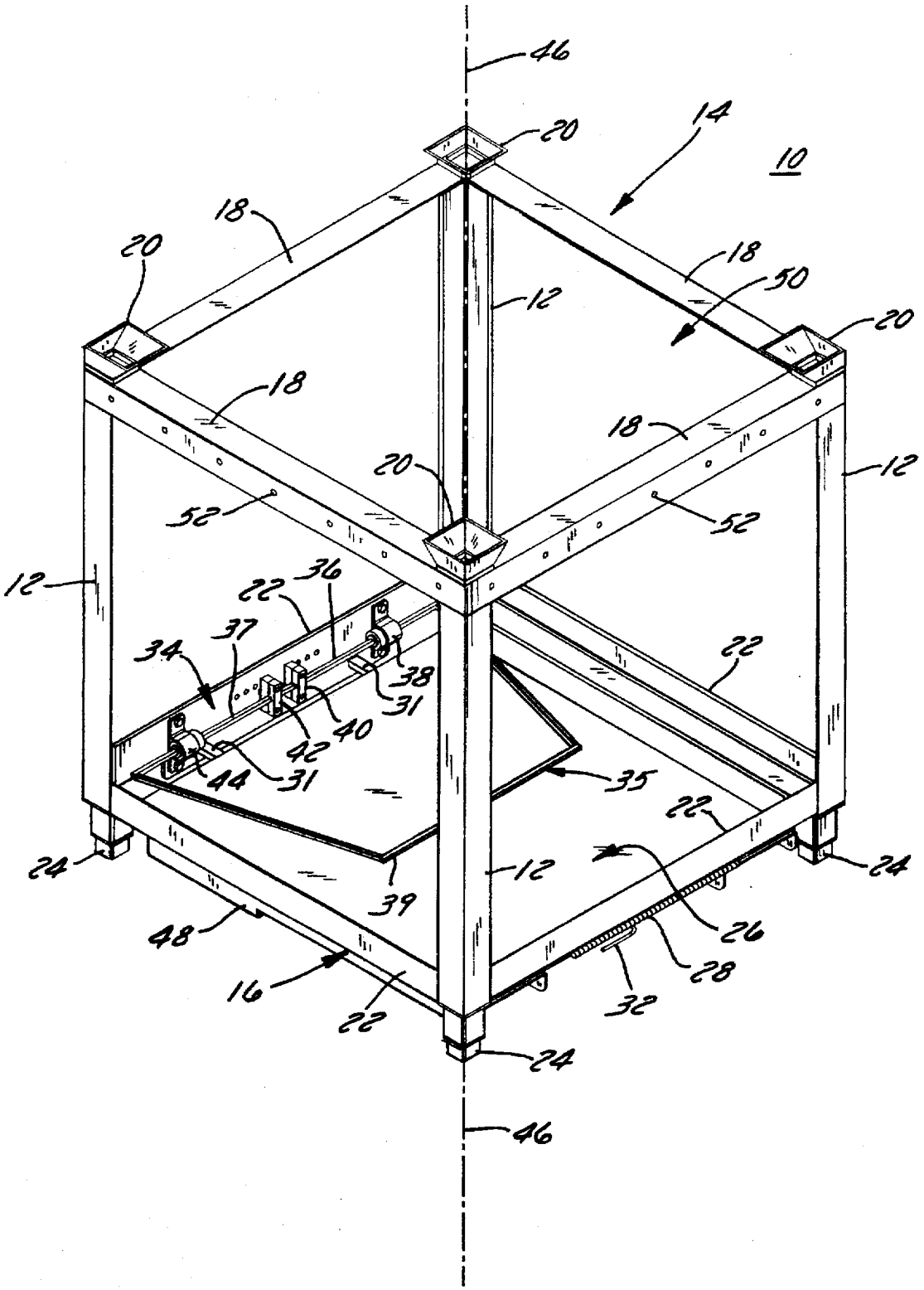
FIG. 1 is a perspective drawing of the frame of the present invention in a closed position.

FIG. 1 is a perspective drawing of the frame of the present invention in a closed position. In FIG. 1, a frame assembly 10 is illustrated comprising a plurality of vertical members 12 joining a top section 14 with a bottom section 16. Top section 14 is comprised of a plurality of top members 18 joining vertical members 12, and a plurality of stacking receptacles 20. Bottom section 16 is comprised of a plurality of bottom members 22 joining vertical members 12, and a plurality of stacking posts 24 appropriately located and sized to be nestingly received within stacking recepticals 20 of a next subjacent frame assembly 10 (not shown in FIG. 1). Thus, stacking post 24 of a first frame assembly and stacking recepticals 20 of a second subjacent frame assembly cooperate to maintain the first and second frame assemblies in a stable stacked relation.

Bottom section 16 further includes a bottom hatch 26 which is attached to one of the bottom members 22 by a hinge mechanism 28. Bottom hatch 26 is maintained in latched relation with an opposing bottom member 22 by latch mechanisms 30. A latch actuator 32 facilitates remote actuation of latch mechanisms 30 to release latch mechanisms 30, thus permitting bottom hatch 26 to swing about hinged mechanism 28 to an open position as shall be discussed in greater detail in connection with FIG. 2.

Still further included in bottom section 16 is a torsion bias structure 34. Torsion bias structure 34 includes a torsion bar 35. Torsion bar 35 includes torsion arm segments 36, 37 and a bail segment 39. Torsion arm segments 36, and 37 are in engagement with torsion arm support members 38, 44 and torsion arm anchor members 40, 42. Thus, as force is applied to bail segment 39, bail segment 39 is displaced downward from its at-rest position illustrated in FIG. 1. As a result, torsion arm segments 36 and 37, cooperate with torsion arm support members 38, 44 and with torsion arm anchor members 40, 42 to store torsion-kinetic energy in torsion arm segments 36, 37 so that when the force which displaced bail segment 39 downward in FIG. 1 is sufficiently eased or removed, the torsion-kinetic energy stored in torsion arm segments 36, 37 urges bail segment 39 to return to its at-rest position illustrated in FIG. 1.

In order to facilitate understanding the present invention, like elements will be identified by like reference numbers in the various drawings.

Figure 2:
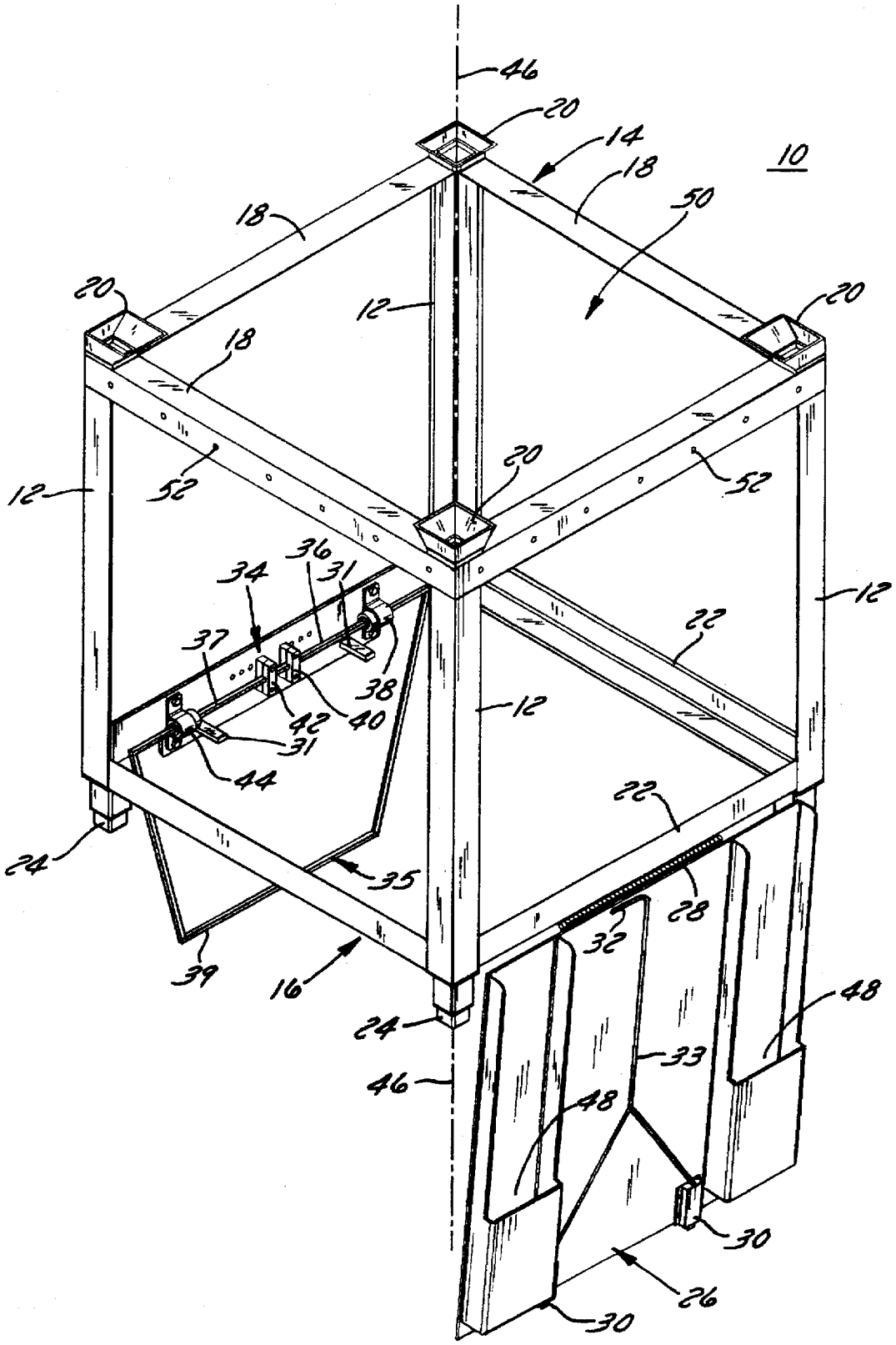
FIG. 2 is a perspective drawing of the frame of the present invention in an open position.
Figure 3A:
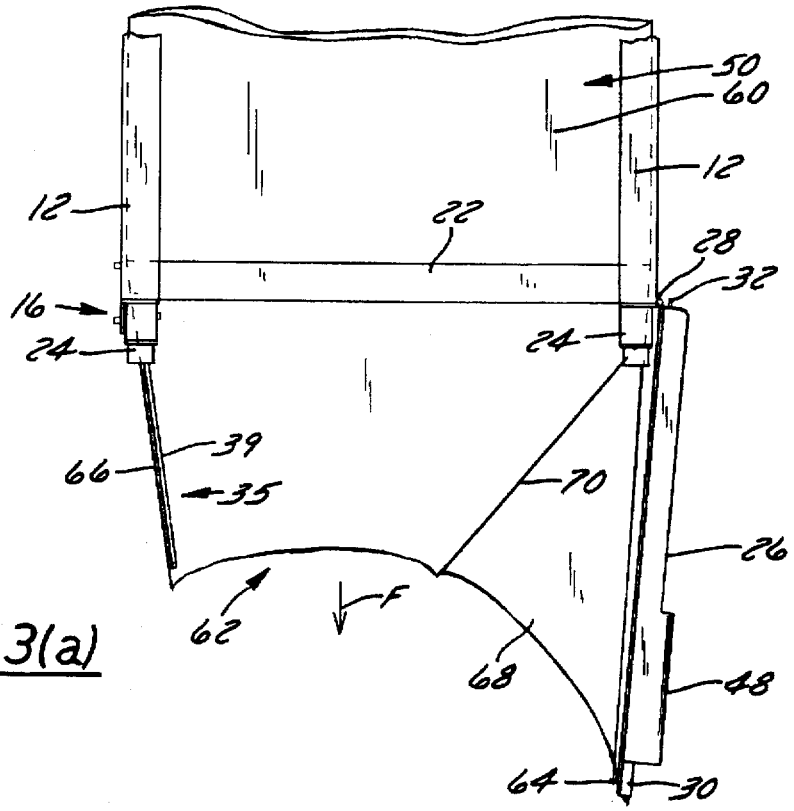
FIG. 3(*a*)–3(*d*) are schematic drawings illustrating four steps of the operation of the present invention in a dumping and subsequent closing operation.
Figure 3B:
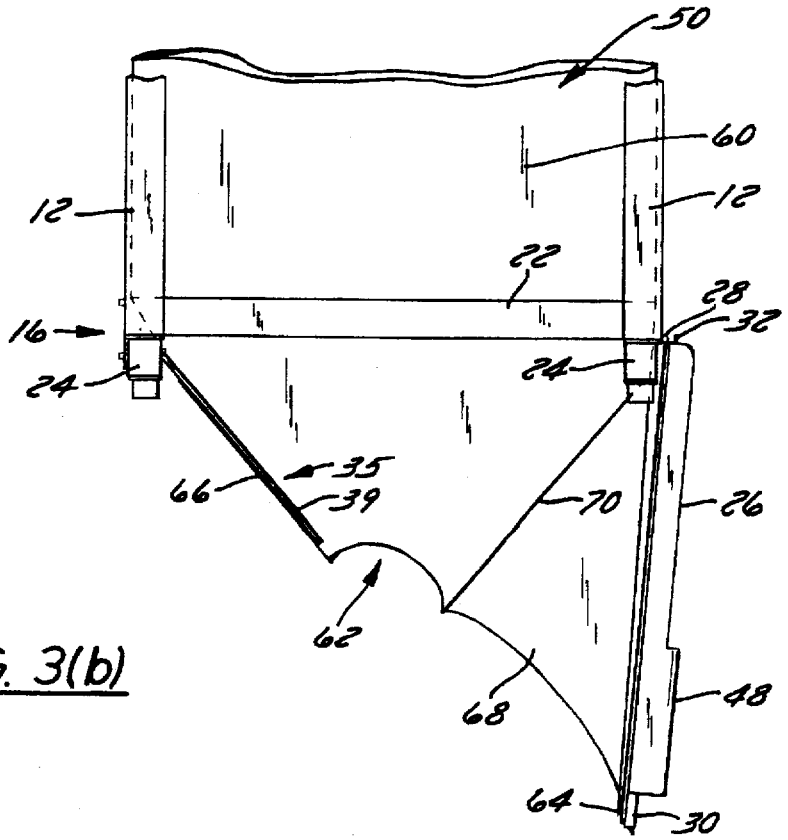
Figure 3C:
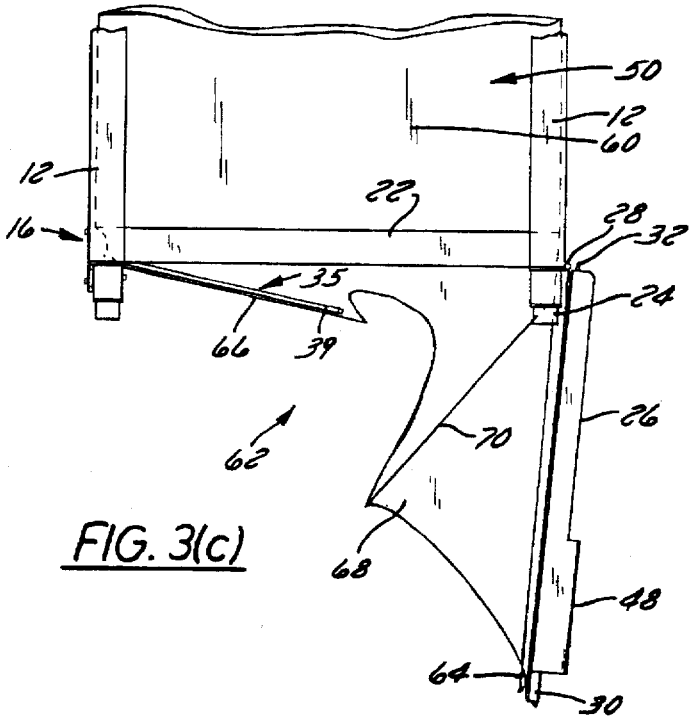
Figure 3D:
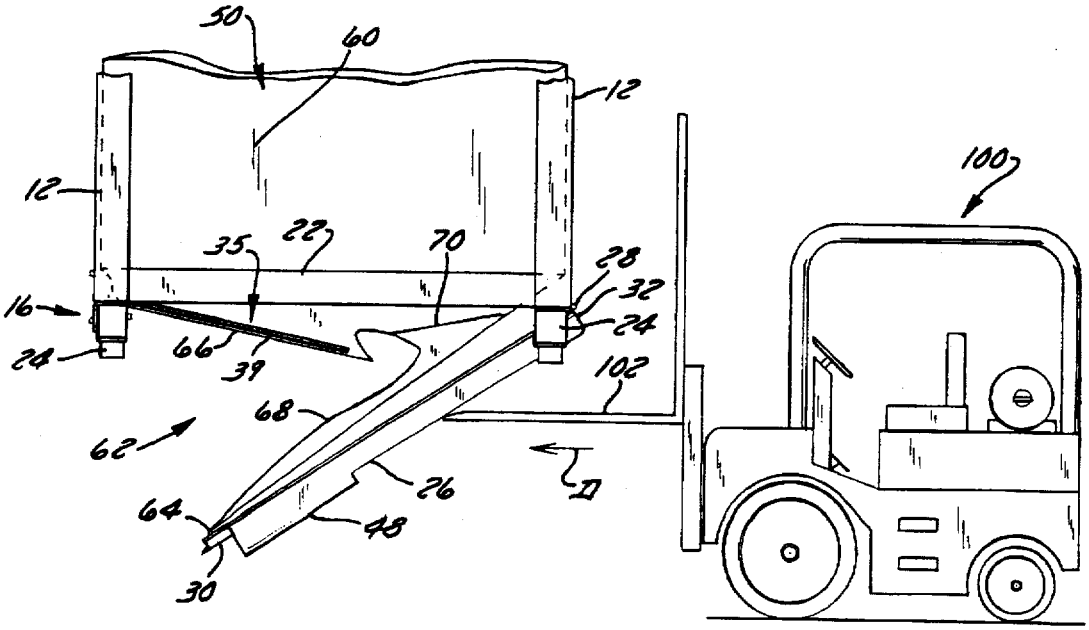

FIG. 2 is a perspective drawing of the frame of the present invention in an open position. In FIG. 2, frame assembly 10 is illustrated with bottom hatch 26 rotated about hinge mechanism 28 to a position substantially establishing an acute angle between a longitudinal axis 46 about which frame assembly 10 is substantially symmetrical and a plane substantially containing bottom hatch 26. Thus, in the position illustrated in FIG. 2, a receptacle suspended within frame assembly 10 and having bottom flaps associated with bottom hatch 26 and torsion bias structure 34 (as will be described in greater detail hereinafter) is oriented for dumping the contents of such a receptacle.

Frame assembly 10 may be oriented to facilitate its being in such an open position by its being placed in a dumping frame (not shown) sufficiently supporting frame assembly 10 at an altitude which permits bottom hatch 26 to swing to the open position illustrated in FIG. 2. Alternatively, by slowly lifting frame assembly 10 above a surface, bottom hatch 26 will bear against such a surface (not shown). By adjusting the height of frame assembly 10, the degree of openness established by bottom hatch 26 is adjusted and hence, the flow rate from a bag or sack contained within frame assembly 10 (to be described later) is adjusted.

In such an open position, further details of bottom hatch 26 are visible. Specifically, bottom hatch 26 has latch mechanisms 30 at its side distal from hinge mechanism 28, which latch mechanisms 30 interact with latch stops 31 on opposing bottom member 22 of bottom section 16 to effect latching (FIG. 1). A lanyard or other remote actuating mechanism 33 connects latch actuator 32 with latch mechanisms 30. Preferably, latch actuator 32 is engagable by a remote tool such as a hook or pole to facilitate tripping latch mechanisms 30 and enabling rotation of bottom hatch 26 about hinge mechanism 28 to the open position illustrated in FIG. 2 without an operator effecting such unlatching being required to be in close proximity with frame assembly 10. Further visible in FIG. 2, bottom hatch 26 includes engagement tracks 48 which, in the preferred embodiment illustrated in FIG. 2, are configured to facilitate engagement with fork members of a forklift vehicle. Engagement tracks 48 enable a forklift vehicle to effect closure of bottom hatch 26 and establish latching of latch mechanisms 30 with latch stops 31, as well as facilitate handling and transport of frame assembly 10 by such a forklift vehicle.

In this preferred embodiment, a receptacle such as a flexible bag or sack (not shown in FIGS. 1 and 2) is suspended within the interior 50 established by vertical members 12, top members 18, and bottom members 22 by such means as hooks through apertures 52, or other known suspension or affixation devices. The bag or sack may be color-coded to indicate ownership, indicate recyclable materials, indicate hazardous materials, or indicate other features. Additionally, the bag or sack may be constructed of porous material so that wet particulate material contained therein may drain or dry. The bag or sack is fillable through a top fill structure of any sort generally configured to facilitate filling the sack. The bottom structure of the sack comprises a dump structure situated in the vicinity of bottom section 16 of frame assembly 10 and discussed in greater detail in connection with FIGS. 3–5.

FIG. 3 is a set of schematic drawings illustrating four steps of the operation of the present invention in a dumping and subsequent closing operation. In FIG. 3(*a*), bottom hatch 26 is illustrated as being in the open or dumping position as discussed in connection with FIG. 2. Vertical members 12 and bottom member 22 cooperate to affix a flexible receptacle 60 within interior 50. Flexible receptacle 60 includes a dump structure 62. Dump structure 62 comprises a first flap 64 affixed to bottom hatch 26. Of course, first flap 64 may be eliminated and its function performed solely by bottom hatch 26 in an alternate embodiment.

A further element of dump structure 60 is a second flap 66. Second flap 66 is in fixed relation with bail segment 39, preferably captively containing bail segment 39 within flap 66 so that flap 66 and bail segment 39 are mutually interconnected. Thus, when a pressure is applied substantially in direction of arrow F in FIG. 3(*a*), as would be the case when there is material contained within flexible receptacle 60, the movement of second flap 66 in response to that force F urges bail segment 39 to an open position substantially as illustrated in FIG. 2. Such forcible movement of second flap 66 also forcibly moves bail segment 39 and establishes torsion-kinetic energy within torsion arm segments 36, 37 (FIGS. 1–2). Similarly, upon removal of the force F, the torsion-kinetic energy stored in torsion arm segments 36, 37 urges bail segment 39 to return to its closed position (as illustrated in FIG. 1), and the mutual dependency between second flap 66 and bail segment 39 returns second flap 66 to a closed position substantially parallel with bottom members 22 of bottom section 16. That is the situation which is illustrated in FIG. 3(*b*).

Further included in dump structure 62 are a pair of side flaps 68 (one of which is visible in FIG. 3). Each side flap 68 is attached with first flap 64 and with second flap 66 at a bottom member 22. Associated with each side flap 68 is a bias member 70 having shape-memory such that as tension is relieved from side flap 68, each bias member 70 urges its respective side flap 68 toward interior 50. In the preferred embodiment, each bias member 70 is fixedly contained within its respective side flap 68.

In FIG. 3(*a*), dump structure 62 is illustrated in its open position for facilitating dumping in response to a force F applied by contents of flexible receptacle 60. In such position, first flap 64 is attached with bottom hatch 26 and has rotated to a position to substantially fully extend side flaps 68. Second flap 66 is similarly substantially fully rotated to an open position. Upon completion, or substantial completion, of emptying of the contents of flexible receptacle 60, force F is removed and torsion arm 36 begins to urge second flap 66 toward its closed position, as illustrated in FIG. 3(*b*). Similarly, the tension applied to bottom hatch 26 which substantially fully extended side flaps 68 is now relieved by the absence of force F. Side flaps 68 are thus only relaxedly extended by the weight of bottom hatch 26 and first flap 64, and bias members 70 begin to urge side flaps 68 toward interior 50, as illustrated in FIG. 3(*b*).

In FIG. 3(*c*), second flap 66 has been further rotated by the torsion-kinetic energy expended by torsion arm segments 36, 37 so that second flap 66 is now nearly in its fully closed position. The weight of bottom hatch 26 prevents its substantial motion toward a closed position, but some motion toward a closed position has occurred in FIG. 3(*c*). How much such motion is experienced by bottom hatch 26 is largely dependent on how heavy bottom hatch 26 is. Bias members 70 have continued to urge the slackened side flaps 68 toward interior 50.

Completion of closure of dump structure 62 is effected by a forklift 80 engaging engagement tracks 48 (FIG. 2) of bottom hatch 26 by its forks 82 and moving in the direction of arrow D (FIG. 3(*d*)) to rotate bottom hatch 26 about hinge mechanism 28. Sufficient such movement in the direction of arrow D effects latching between latch mechanisms 30 and latch stops 31 (FIGS. 1–2). During such motion by forklift 80 in the direction of arrow D, bias members 70 continue to urge side flaps 68 toward interior 50.

Figure 4:
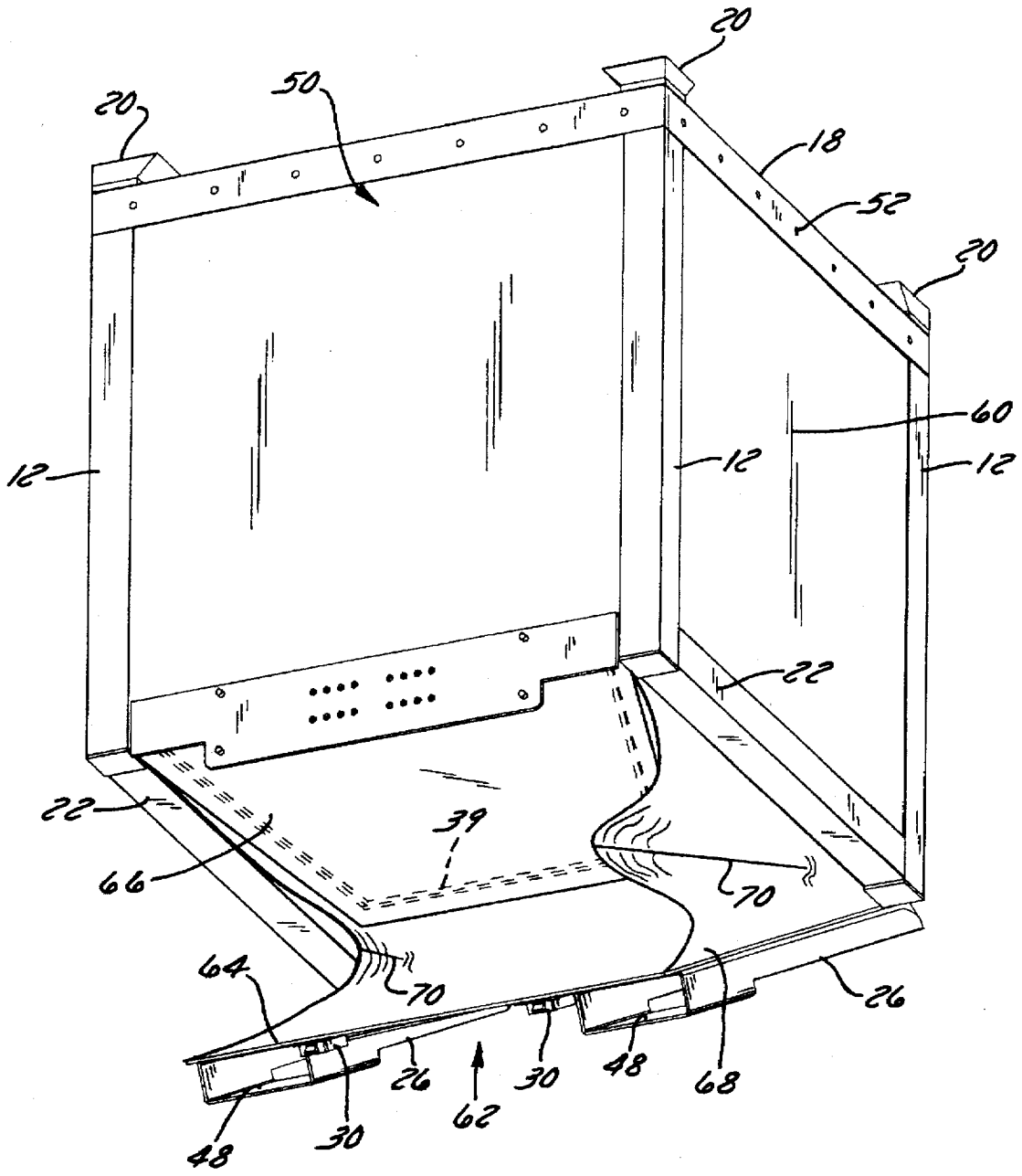
FIG. 4 is a perspective schematic illustration of details of the dump structure of the present invention.

FIG. 4 is a perspective schematic illustration of details of the dump structure of the present invention. In FIG. 4, a perspective view substantially similar to the stage of closure illustrated in FIG. 3(*d*) is presented. Thus, in FIG. 4, flexible receptacle 60 is shown suspended within the interior 50 established by vertical members 12, top members 18, and bottom members 22. Second flap 66 has been urged by bail segment 39 to a substantially fully closed position and bottom hatch 26 has been partially rotated allowing side flaps 68 to relax and respond to bias members 70 to be urged toward interior 50. Continued rotation of bottom hatch 26 about hinge mechanism 28 will effect a latching relationship between latch mechanisms 30 and latch stops 31 (FIGS. 1–2).

Figure 5:
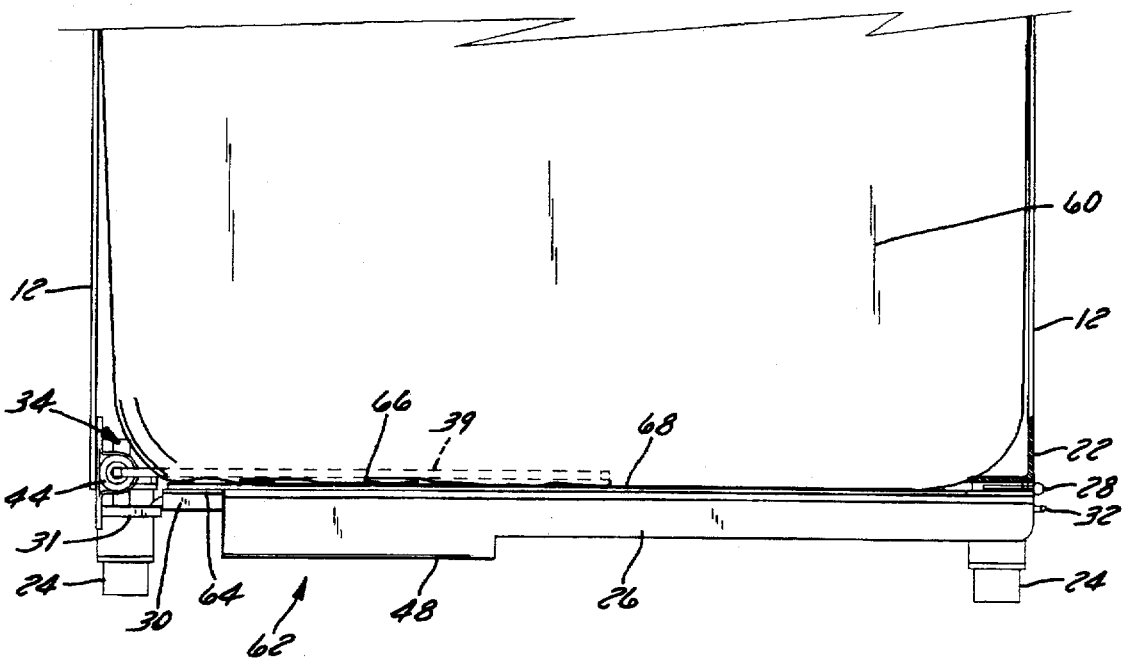
FIG. 5 is a side schematic view of details of the dump structure of the present invention when closed.

FIG. 5 is a side schematic view of details of the dump structure of the present invention when closed. In FIG. 5, flexible receptacle 60 is suspended intermediate bottom members 22. Bottom hatch 26 is fixed at its right end by hinge mechanism 28, and is latched (details not shown) at its left end. Second flap 66 is in its closed position substantially parallel with bottom members 22, and side flaps 68 are each folded intermediate second flap 66 and bottom hatch 26 (which may support a first flap 64; not shown in FIG. 5). Such folding of side flaps 68 is effected by the action of bias members 70 urging side flaps 68 toward interior 50 during rotation of bottom hatch 26 about hinge mechanism 28, as illustrated in FIGS. 3–4. Such inward folding enhances the blocking action of dump structure 62 in its closed position to preclude escape by particulate materials from interior 50.

The inventor has found that the blocking action provided by cooperation among second flap 66, bottom hatch 26, and first flap 64 (if present) with folded side flaps 68 intermediate second flap 66 and bottom hatch 26 is sufficient to even preclude escape from interior 50 of fine particulate material, such as particulate material of approximately the size of talcum powder particles.

Figure 6:
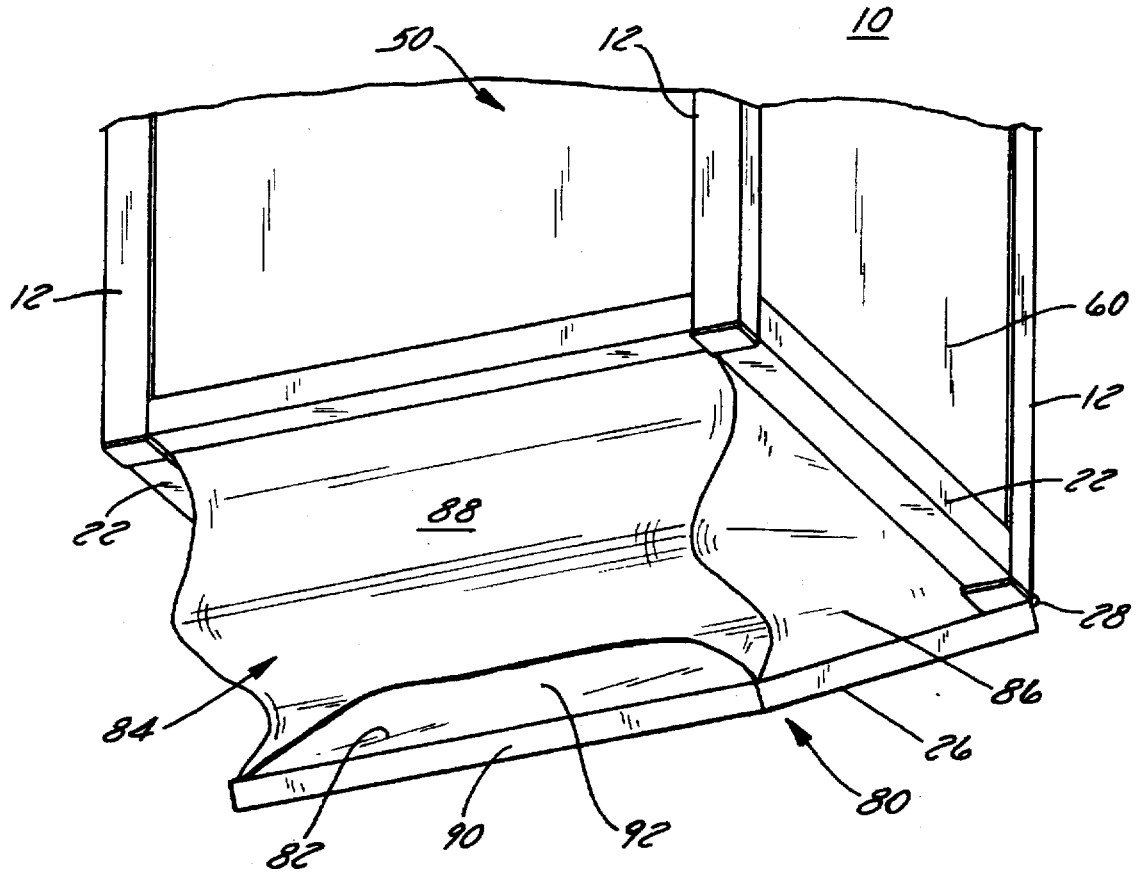
FIG. 6 is a perspective schematic illustration of details of the dump structure of an alternate embodiment of the present invention.

FIG. 6 is a perspective schematic illustration of details of the dump structure of an alternate embodiment of the present invention. In FIG. 6, a perspective view substantially similar to the stage of closure illustrated in FIGS. 3(*d*) and FIG. 4 is presented. Thus, in FIG. 6, a flexible receptacle 60 is shown suspended within the interior 50 established by vertical members 12, bottom members 22, and top members 18 (not shown in FIG. 6).

The dump structure 80 of the alternate embodiment of the present invention illustrated in FIG. 6 is different than dump structure 62 illustrated in FIGS. 1–5. Dump structure 80 includes a flap 82 which may be attached with bottom hatch 26 (or bottom hatch 26 may itself replace the whole of flap 82), and a chute structure 84. Chute structure 84 comprises side chute panels 86 connected with bottom hatch 26 (and, if present, flap 82) and bottom member 22. Chute structure 84 further includes a front chute panel 88 which is connected with bottom member 82, with each side chute panel 86, and with the remote ends of the front edge 90 of bottom hatch 26 to define an opening 92 which provides access to interior 50.

Thus, as bottom hatch 26 rotates about its hinged mechanism 28, opening 92 is more or less blocked in its access to interior 50 by folds in side chute panels 86 and front chute panel 88. That is, as bottom hatch 26 is further opened (or, in the alternative, as frame assembly 10 raised) opening 92 is less obstructed and contents of flexible receptacle 60 may more easily flow from interior 50 through opening 92. As bottom hatch 26 is further closed, opening 92 is more obstructed and flow from interior 50 through opening 92 is less free. In its preferred configuration, the alternate embodiment illustrated in FIG. 6 includes fork-engaging structures (not shown in FIG. 6) which enable engagement of frame assembly 10 in the vicinity of bottom hatch 26 or in the vicinity of top members 18 (not shown in FIG. 6) to enable a fork lift to raise or lower frame assembly 10, thereby clearing or obstructing opening 92 to an extent depending upon the position of bottom hatch 26.

It is to be understood that, while the detailed drawings and specific examples given describe preferred embodiments of the invention, they are for the purpose of illustration, that the apparatus of the invention is not limited to the precise details and conditions disclosed, and that various changes may be made therein without departing from the spirit of the invention which is defined by the following claims.

We claim:

1. An improved apparatus for conveying a particulate material; the apparatus including a generally flexible receptacle substantially fixedly situated within a space delimited by a frame; said receptacle having a top, a bottom, and at least one wall connecting said top with said bottom and defining an interior; said receptacle being coupled with said frame at a plurality of coupling loci; said frame having a longitudinal axis substantially perpendicular with said top and with said bottom of said receptacle when said receptacle is substantially fixedly located within said frame; said receptacle having a fill structure at said top for providing filling access to said interior; the improvement comprising:

a dump structure at said bottom for providing dumping access to said interior; said dump structure comprising a dump aperture;

a first flap; said first flap having a first articulate connection along a first flap width with said at least one wall and with said frame adjacent said dump aperture; said first flap extending a first flap length from said first articulate connection and being swingingly positionable about said first articulate connection from a closed position substantially blocking said dump aperture to an open position, a first plane substantially containing said first flap forming an acute angle with said axis when said first flap is in said open position;

a second flap; said second flap having a second articulate connection along a second flap width with said at least one wall and with said frame adjacent said dump aperture; said second flap extending a second flap length from said second articulate connection and being swingingly positionable about said second articulate connection from a closed position substantially blocking said dump aperture to an open position, a second plane substantially containing said second flap forming an acute angle with said axis when said second flap is in said open position;

at least one side flap; each respective side flap of said at least one side flap being articulately connected with said at least one wall substantially adjacent said dump aperture intermediate said first flap and said second flap; each said respective side flap having a third articulate connection along a third flap width with said at least one wall and a fourth articulate connection with said first flap substantially along said first flap length; and a first bias means coupled with said second flap; said first bias means urging said second flap toward said closed position.

2. An improved apparatus for conveying a solid particulate material as recited in claim 1 wherein the improvement further comprises a second bias means coupled with each said respective side flap; each said second bias means urging each said respective side flap toward said interior.

3. An improved apparatus for conveying a solid particulate material as recited in claim 1 wherein said first bias means is a torsion spring member connecting said second flap with said frame substantially at said second articulate connection.

4. An improved apparatus for conveying a solid particulate material as recited in claim 2 wherein said first bias means is a torsion spring member connecting said second flap with said frame substantially at said second articulate connection.

5. An improved apparatus for conveying a solid particulate material as recited in claim 4 wherein said at least one wall is four walls and wherein said interior is substantially a right parallelepiped.

6. An improved apparatus for conveying a solid particulate material as recited in claim 1 wherein said at least one side flap is two side flaps, wherein said first flap and said second flap are each substantially rectangular shaped, and wherein said first flap width and said second flap width are located at opposing faces of said parallelepiped.

7. An improved apparatus for conveying a solid particulate material as recited in claim 4 wherein said at least one side flap is two side flaps, wherein said first flap and said second flap are each substantially rectangular shaped, and wherein said first flap width and said second flap width are located at opposing faces of said parallelepiped.

8. An improved apparatus for conveying a solid particulate material as recited in claim 5 wherein said at least one side flap is two side flaps, wherein said first flap and said second flap are each substantially rectangular shaped, and wherein said first flap width and said second flap width are located at opposing faces of said parallelepiped.

9. An apparatus for storing and transporting a solid particulate material; the apparatus comprising:

a frame, said frame including a plurality of frame members arranged to delimit a substantially right polyhedron; said polyhedron having a top, a bottom, a plurality of sides, an open interior, and a longitudinal axis substantially perpendicular with said top and with said bottom; and a repository, said repository being coupled with said frame and substantially fixedly oriented within said open interior; said repository having a fill aperture in a top end, said fill aperture being accessible through said top of said frame for filling said repository with said material; said repository having a dump system in a bottom end opposite said top end, said dump system and said bottom of said frame being arranged to facilitate emptying said material from said repository;

said dump system comprising a dump aperture, a first flap having a first articulate connection with said repository substantially adjacent said dump aperture and swingingly orientable about said first articulate connection from a closed position substantially blocking said dump aperture to an open position substantially unblocking said dump aperture;

a second flap having a second articulate connection with said repository substantially adjacent said dump aperture and swingingly orientable about said second articulate connection from a closed position substantially blocking said dump aperture to an open position substantially unblocking said dump aperture;

at least one side flap; each respective side flap of said at least one side flap having a third articulate connection with said repository substantially adjacent said dump aperture intermediate said first articulate connection and said second articulate connection; each said respective side flap having a fourth articulate connection with said first flap; and a first bias means coupled with said second flap; said first bias means urging said second flap toward said closed position.

10. An apparatus for storing and transporting a solid particulate material as recited in claim 9 wherein the improvement further comprises a second bias means coupled with each said respective side flap; each said second bias means urging each said respective side flap toward said interior.

11. An apparatus for storing and transporting a solid particulate material as recited in claim 9 wherein said first bias means is a torsion spring member connecting said second flap with said frame substantially at said second articulate connection.

12. An apparatus for storing and transporting a solid particulate material as recited in claim 10 wherein said first bias means is a torsion spring member connecting said second flap with said frame substantially at said second articulate connection.

13. An apparatus for storing and transporting a solid particulate material as recited in claim 12 wherein said at least one wall is four walls and wherein said polyhedron is substantially a parallelepiped.

14. An apparatus for storing and transporting a solid particulate material as recited in claim 9 wherein said at least one side flap is two side flaps, wherein said first flap and said second flap are each substantially rectangular shaped, and wherein said first articulate connection and said second articulate connection are located at opposing faces of said parallelepiped.

15. An apparatus for storing and transporting a solid particulate material as recited in claim 12 wherein said at least one side flap is two side flaps, wherein said first flap and said second flap are each substantially rectangular shaped, and wherein said first articulate connection and said second articulate connection are located at opposing faces of said parallelepiped.

16. An apparatus for storing and transporting a solid particulate material as recited in claim 13 wherein said at least one side flap is two side flaps, wherein said first flap and said second flap are each substantially rectangular shaped, and wherein said first articulate connection and said second articulate connection are located at opposing faces of said parallelepiped.

17. An apparatus for storing and transporting a solid particulate material; the apparatus comprising:

a frame; said frame having a top and a bottom generally opposite said top, said frame including a support frame and a hatch, said support frame including a plurality of frame members arranged to delimit an interior, said hatch being swingingly coupled with said support frame at said bottom; and a repository; said repository being coupled with said frame and substantially fixedly oriented within said interior; said repository having a fill aperture at said top, said fill aperture being accessible through said frame for filling said repository with said material; said repository having a dump system at said bottom; said dump system being configured to facilitate emptying said material from said repository while said repository remains coupled with said frame;

said dump system comprising a dump aperture coupled with said support frame and coupled with said hatch in a manner facilitating opening said dump aperture when said hatch is in a first position and closing said dump aperture when said hatch is in a second position.

18. An apparatus for storing and transporting a solid particulate material as recited in claim 17 wherein said dump aperture accommodates various rates of dumping of said material from said repository when said dump aperture is opened varying amounts as said hatch is oriented in various positions intermediate said first position and said second position, said dump aperture accommodating faster dumping rates as said hatch approaches said first position.

19. An apparatus for storing and transporting a solid particulate material as recited in claim 17 wherein said frame further includes a plurality of fork accommodating structures for accommodating forks of a fork lift device in moving the apparatus.

20. An apparatus for storing and transporting a solid particulate material as recited in claim 19 wherein said dump aperture accommodates various rates of dumping of said material from said repository when said dump aperture is opened varying amounts as said hatch is oriented in various positions intermediate said first position and said second position, said dump aperture accommodating faster dumping rates as said hatch approaches said first position.

* * * * *